US005667365A

United States Patent [19]

Miller et al.

[11] Patent Number: 5,667,365

[45] Date of Patent: Sep. 16, 1997

[54] EXPANDABLE MIXING SECTION GRAVEL AND COBBLE EDUCTOR

[75] Inventors: Arthur L. Miller, Kenyon; Kenneth I. Krawza, Lakeville, both of Minn.

[73] Assignee: The United States of America as represented by the Department of Energy, Washington, D.C.

[21] Appl. No.: 615,071

[22] Filed: Mar. 14, 1996

Related U.S. Application Data

[63] Continuation of Ser. No. 344,590, Nov. 18, 1994, abandoned.

[51] Int. Cl.[6] ..... F04F 5/36

[52] U.S. Cl. ..... 417/151; 417/195

[58] Field of Search ..... 417/151, 195

[56] References Cited

U.S. PATENT DOCUMENTS

| | | | |
|---|---|---|---|
| 323,458 | 8/1885 | Smith et al. | 417/151 |
| 1,150,473 | 8/1915 | Wisely | 417/151 |
| 3,816,027 | 6/1974 | Miscovich | 417/184 |
| 3,891,353 | 6/1975 | Templeman | 417/183 |
| 3,942,962 | 3/1976 | Duychinck | 417/195 |

FOREIGN PATENT DOCUMENTS

| | | | |
|---|---|---|---|
| 1041767 | 9/1983 | U.S.S.R. | 417/151 |
| 1090929 | 5/1984 | U.S.S.R. | 417/151 |

*Primary Examiner*—Michael Koczo
*Assistant Examiner*—Ted Kim
*Attorney, Agent, or Firm*—Mark LaMarre; Mark P. Dvorscak; William R. Moser

[57] ABSTRACT

In a hydraulically powered pump for excavating and transporting slurries in which it is immersed, the improvement of a gravel and cobble eductor including an expandable mixing section, comprising: a primary flow conduit that terminates in a nozzle that creates a water jet internal to a tubular mixing section of the pump when water pressure is applied from a primary supply flow; a tubular mixing section having a center line in alignment with the nozzle that creates a water jet; a mixing section/exit diffuser column that envelopes the flexible liner; and a secondary inlet conduit that forms an opening at a bas portion of the column and adjacent to the nozzle and water jet to receive water saturated gravel as a secondary flow that mixes with the primary flow inside of the mixing section to form a combined total flow that exits the mixing section and decelerates in the exit diffuser.

2 Claims, 1 Drawing Sheet

EXPANDABLE MIXING SECTION GRAVEL AND COBBLE EDUCTOR

This application is a continuation of application Ser. No. 08/344,590 filed Nov. 18, 1994, now abandoned.

FIELD OF THE INVENTION

The present invention relates to an expandable mixing section gravel and cobble eductor for the pumping and lifting of slurries containing large size particles, in which the eductor has a reduced size mixing section that improves maximum lift performance as well as pumping efficiency for unconsolidated materials and/or slurries containing large solid particles. In particular, the eductor has no mechanical moving parts, is built from a variety of abrasive resistant materials, can handle very large solid particles such as rocks/boulders, can be placed remotely from its power source, and incorporates a mixing section which is resistant to plugging.

BACKGROUND OF THE INVENTION

It is known that there are only a few methods available as a practical matter for pumping/lifting of gravel slurries, particularly slurries containing cobbles or boulders; however, amongst the four methods known, there are serious disadvantages attendant to their use.

For example, the elevator and/or bucket lift is accomplished using hinged parts which are subject to considerable wear when used in the presence of sand and gravel. Further, in the elevator and/or bucket lift method, the ability to transport liquid is also limited by bucket size and shape and angular orientation.

While the second or conveyor lift method is less susceptible to abrasion wear, it nevertheless does not effectively transport the liquid portion of a slurry. Moreover, the steepness of the angle at which the lift can be used is also greatly limited, as the slurry does not adhere to the conveyor belt.

The third or centrifugal pump method is the most common method of transporting slurries; however, this method is encumbered by two disadvantages, both of which are overcome by using a hydraulic lift. The first disadvantage is that the geometrical design of the impellers and casing make it difficult to build a reasonable-sized pump that will handle large rocks. The second disadvantage is that the pump, which is large and requires an even larger driving motor, must be located at the slurry source. Accordingly, if pumping from a pit or well, the pump must be placed at the bottom, which may be logistically difficult.

The fourth or standard hydraulic lift method has no moving parts, can be built to handle large-sized solid material such as rocks, and can be located remotely from its power source; however, two prominent disadvantages encumber this method. The first disadvantage is that the mixing section of the lift is typically a rigid abrasive-resistant material that will not yield if a rock gets wedged in that section. The second disadvantage is that the efficiency of the lift and the maximum lift height attainable are directly related to the inside diameter of the mixing section. Therefore, when the mixing section size is increased to accommodate larger rocks or other solid particles, both the performance and efficiency decrease.

There is a need to overcome the disadvantages attendant to the standard hydraulic lift method; namely: 1) to resolve the fact that the mixing section of the lift will not yield if a rock gets wedged in that section due to the rigid nature of the abrasive-resistant material of the mixing section; and 2) to overcome the encumbrances that the efficiency of the lift and the maximum lift height attainable are directly related to the inside diameter of the mixing section (for example, if the mixing section size is increased to accommodate larger rocks or other solid particles, both the performance and efficiency decrease).

SUMMARY OF THE INVENTION

One object of the invention is to provide an expandable mixing section gravel and cobble eductor that provides efficient pumping and lifting of unconsolidated materials and/or slurries containing large solid particles.

Another object of the invention is to provide an expandable mixing section gravel and cobble eductor that provides efficient pumping and lifting of unconsolidated materials and/or slurries containing large solid particles wherein the gravel and cobble eductor is free from mechanically moving parts.

A further object of the invention is to provide an expandable mixing section gravel and cobble eductor which can be built to handle very large solid particles such as rocks and boulders.

A still further object of the invention is to provide an expandable mixing section gravel and cobble eductor that can be placed remotely from its power source.

A yet further object of the invention is to provide an expandable mixing section gravel and cobble eductor that incorporates a mixing section which is resistant to plugging.

A further object yet still of the invention is to provide an expandable mixing section gravel and cobble eductor which allows reduction in size of the mixing section to improve maximum lift performance as well as pumping efficiency for materials containing large solid particles.

In general, the invention is accomplished by providing an improved gravel and cobble eductor pump comprising a primary-flow water pump nozzle that exits in alignment with the center line of a tubular mixing section exit diffuser column, wherein the base section of the column has a secondary slurry inlet opening in proximity to the nozzle exit from the primary flow supply.

The pump is placed into the medium which it must transport, in this case, water-saturated gravel, and pressure is applied to the nozzle via the primary-supply flow conduit and a water jet exits the nozzle in alignment with the center line of the tubular mixing section. Any material which comes in contact with the surface of this jet (solid, liquid, or gas) is accelerated by friction drag and thus entrained into the flow. Entrained material constitutes the "secondary flow", which physically mixes and exchanges energy with the primary flow inside the mixing section. The combined flow "total flow" exits the mixing section and decelerates in the exit diffuser, and in so doing the kinetic energy is converted to potential (pressure) energy which drives the pumping or transportation of the exiting flow.

DETAILED DESCRIPTION OF THE INVENTION

Figure 1:
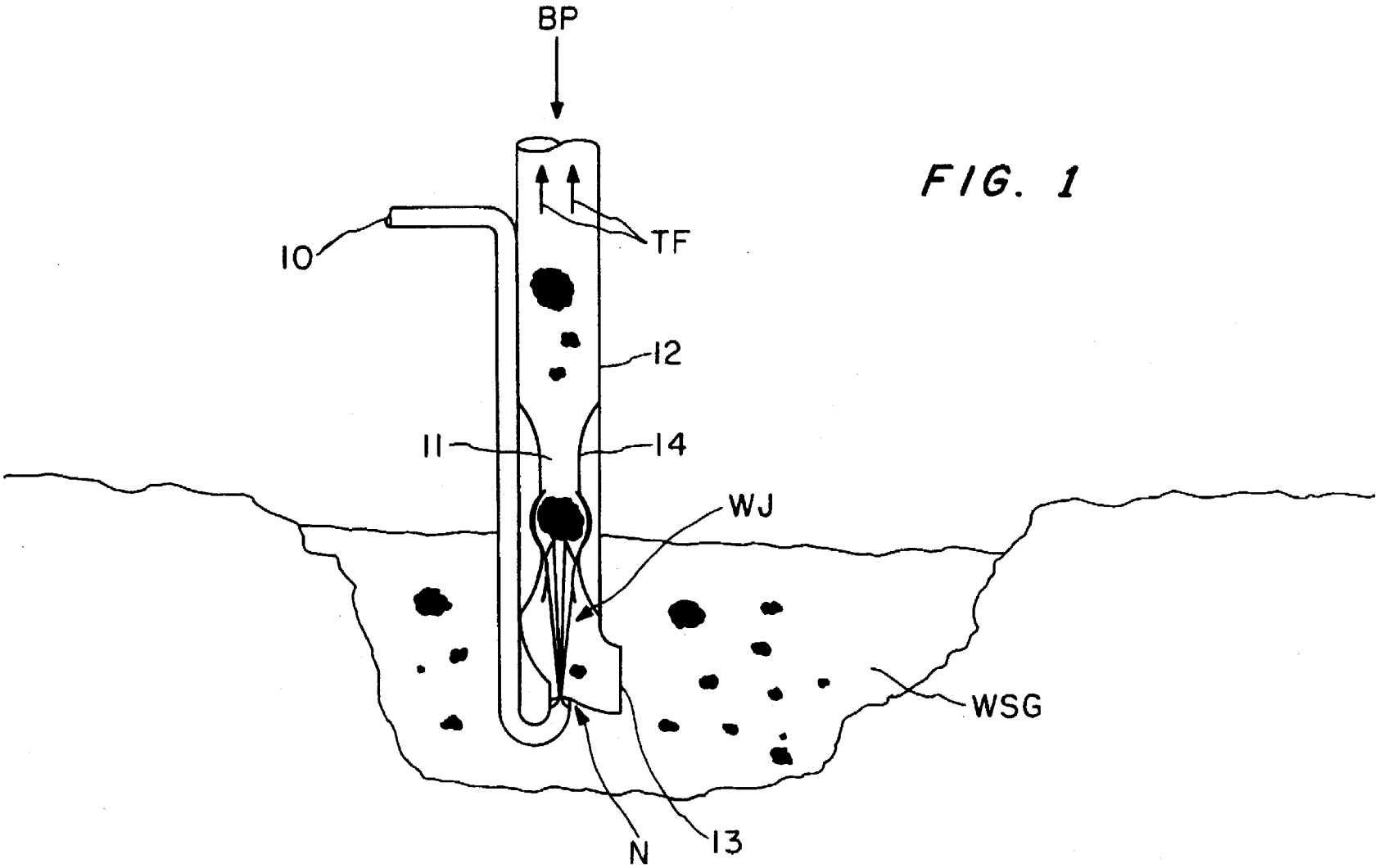
FIG. 1 shows the improved gravel and cobble eductor pump immersed in a water saturated gravel. The pump comprises a primary flow conduit with a nozzle that exits along the center line of a non-abrasive flexible liner in the tubular mixing section/exit diffuser column, and the column has a secondary slurry inlet flow opening in proximity to the exiting nozzle of the primary flow, so that water from the primary flow and the secondary inlet flow creates a combined "total flow" that exits the mixing section and decelerates in the exit diffuser.

Reference is now made to FIG. 1, which shows the improved gravel and cobble eductor with the expandable mixing section immersed in water saturated gravel (WSG), which is the medium it must transport.

In operation, water pressure is applied to the nozzle N of the primary flow supply conduit 10 and a water jet WJ exits the nozzle, which is aligned with the center line of the tubular mixing section 11. Any material which comes in contact with the surface of this jet (solid, liquid, or gas) is accelerated by friction drag and thereby entrained into the flow. This entrained material constitutes the "secondary flow" which enters slurry inlet 13, disposed at the base of the mixing section/exit diffuser column in proximity to the point at which the nozzle from the primary flow conduit aligns with the center line of the tubular mixing section, and this "secondary flow" physically mixes and exchanges energy with the primary flow inside the mixing section. The combined flow or "total flow" TF exits the mixing section and decelerates in the exit diffuser 12, where kinetic energy is converted to potential (pressure) energy which drives the pumping or transportation of the exiting flow, and where a back pressure (BP) from the pumping head (not shown) develops.

The mixing section is made of a non-abrasive flexible liner 14, and the usefulness of this invention is realized when an oversized solid particle enters the mixing section. The oversized particle wedges itself against the walls, whereupon the primary jet is blocked and a stagnation pressure builds below the obstruction. With this pressure to drive it, rather than wedging tightly into the mixing section, it is driven vertically, and the mixing section's flexible walls become deformed along the way to allow passage of the oversized particle. This accomplishes two things, first it prevents clogging of the mixing section, and secondly, it allows a smaller diameter mixing section to be used, and this increases performance.

The driving force of the improved gravel and cobble eductor with expandable mixing section pump of the invention is related not only to the power available in the primary flow but also to the ability of the mixing section to maintain a "dynamic seal" against the pressure present in the outlet piping. The effectiveness of this dynamic seal is directly related to the width of the gap between the "core diameter" of the primary jet (nozzle diameter) and the inside diameter of the mixing section. Another way to express this is that the output pressure attainable is related to the ratio of the nozzle cross-sectional area and the cross-sectional area of the mixing section.

It has been found that the attainable output pressure or performance is best when the ratio of the nozzle cross-sectional area and the cross-sectional area of the mixing section is about 0.2 to 0.3.

A jet pump of the invention design with a mixing section diameter of 5 inches is capable of passing slurry containing much larger rocks, up to approximately 7 inches, but has the same performance capabilities as a standard 5-inch jet pump.

Similarly, a jet pump of the invention design built with a 3½ inch diameter mixing section is capable of passing rocks as large as 5 inches in diameter. This pump has the same material handling capability as a 5-inch pump, but with a much smaller mixing section diameter. This permits a decrease in the nozzle size (which increases pressure, assuming constant horsepower), and the nozzle can now be operated at higher pressure, thereby increasing the maximum pumping head.

The mixing section may be fabricated in various ways to allow passage of oversized objects. These include, but are not limited to, the following:

A) A flexible inner liner surrounded by an annulus of compressible material such as foam rubber or collapsible ribs/webs;

B) A flexible inner liner surrounded by a liquid or gaseous region which would allow the liner to deform. The pressure in this region may also be regulated to vary compressibility of the annulus; and C) The inner liner can be protected with wear plates or rods made from a material more abrasive resistant than the liner itself.

In a further alternative embodiment of the invention, the geometry of the inlet conduit could be changed from the 90° elbow inlet shown in FIG. 1 to a larger 360° annular inlet with or without a "cage" or inlet grating.

Further, the inlet area may be completely enclosed except for a small opening in the side, just above the nozzle exit.

Still further, the inlet area may be made to converge into a conduit, and this conduit could be made flexible and have a length of up to several yards, much like a vacuum cleaner hose.

The advantages of the invention jet pump over those of the prior art for pumping/lifting of large-particulate slurries are that the invention pump:

has no mechanically moving parts;

can be built from a variety of abrasive resistant materials;

can be built to handle very large solid particles such as rocks/boulders;

can be placed remotely from its power source;

incorporates a mixing section which is resistant to plugging; and allows reduction in size of the mixing section to improve maximum lift performance as well as pumping efficiency for materials containing large solid particles.

While it is readily apparent that the improved jet pump of the invention is characterized by an abrasive resistant mixing section, a flexible expandable mixing section, and a self-cleaning mixing section, it is to be understood that the foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a hydraulically powered pump for excavating and transporting slurries in which it is immersed, the improvement of a gravel and cobble eductor comprising: a tubular expandable mixing section having a center line in alignment with a nozzle capable of lifting cobbles larger than the diameter of the mixing section;

a primary flow conduit that terminates in a nozzle that creates a water jet internal to said tubular expandable mixing section of said pump when water pressure is applied from a primary supply flow;

said tubular expandable mixing section being enclosed by a flexible liner having a center line in alignment with said nozzle that creates a water jet;

an exit diffuser column that envelopes said flexible liner; and a secondary inlet conduit that forms an opening at a base portion of said exit diffuser column and adjacent to said nozzle and water jet to receive water saturated gravel as a secondary flow that mixes with said primary flow inside of said mixing section to form a combined total flow that exits said mixing section and decelerates in said exit diffuser.

2. The hydraulically powered pump of claim 1, wherein a cross-sectional area of said nozzle and a cross-section area of said mixing section has a ratio of from about 0.2 to about 0.3.

* * * * *